US012359413B2

(12) United States Patent
Smith et al.

(10) Patent No.: US 12,359,413 B2
(45) Date of Patent: Jul. 15, 2025

(54) RECONFIGURABLE FLAPPER FOR DIFFERENT SIZED FLUSH VALVES

(71) Applicants: Jordan D. Smith, Waukesha, WI (US); Glenn W. Brown, Franklin, WI (US)

(72) Inventors: Jordan D. Smith, Waukesha, WI (US); Glenn W. Brown, Franklin, WI (US)

(73) Assignee: Lavelle Industries, Inc., Burlington, WI (US)

( * ) Notice: Subject to any disclaimer, the term of this patent is extended or adjusted under 35 U.S.C. 154(b) by 963 days.

(21) Appl. No.: 17/411,272

(22) Filed: Aug. 25, 2021

(65) Prior Publication Data

US 2022/0064924 A1 Mar. 3, 2022

Related U.S. Application Data

(60) Provisional application No. 63/070,637, filed on Aug. 26, 2020.

(51) Int. Cl.
*E03D 1/35* (2006.01)

(52) U.S. Cl.
CPC ..... *E03D 1/35* (2013.01)

(58) Field of Classification Search
CPC ..... E03D 1/306; E03D 1/34–35
USPC ..... 4/378, 392–395
See application file for complete search history.

(56) References Cited

U.S. PATENT DOCUMENTS

| | | | | |
|---|---|---|---|---|
| 3,360,803 | A * | 1/1968 | Gross | E03D 1/306 4/393 |
| 3,368,224 | A * | 2/1968 | Ament | E03D 1/308 4/393 |
| 3,397,409 | A * | 8/1968 | Schlank | E03D 1/306 4/393 |
| 4,497,076 | A * | 2/1985 | Sullivan | E03D 1/142 4/395 |
| 4,841,579 | A * | 6/1989 | Antunez | E03D 1/35 4/395 |
| 5,390,375 | A * | 2/1995 | Fernstrum, Jr. | E03D 1/142 4/393 |
| 6,401,268 | B2 | 6/2002 | Higgins | |
| 8,104,103 | B2 | 1/2012 | Han | |
| 8,122,526 | B2 | 2/2012 | Li | |
| 8,196,898 | B1 | 6/2012 | Huang | |
| 8,250,681 | B2 | 8/2012 | Han | |
| 8,365,320 | B1 * | 2/2013 | Lordahl | E03D 1/34 4/417 |
| 9,791,049 | B2 | 10/2017 | Guthrie et al. | |
| 10,190,300 | B2 | 1/2019 | Guthrie | |
| 2004/0172747 | A1 * | 9/2004 | Sirizzotti | E03D 1/306 4/392 |
| 2005/0283896 | A1 * | 12/2005 | Huang | E03D 1/35 4/404 |

(Continued)

*Primary Examiner* — Erin Deery
*Assistant Examiner* — William R Klotz
(74) *Attorney, Agent, or Firm* — Reinhart Boerner Van Deuren P.C.

(57) ABSTRACT

A flapper assembly for a flush valve as well as method of assembly are provided. The flapper assembly includes a frame and multiple buoyancy assemblies attachable to the frame so as to adjust the buoyancy of the flapper assembly. The flapper assembly kit may have adjustable legs attachable to the frame. The flapper assembly kit may have multiple seal members for use in sealing with different sized/shaped valve seats of different sized flush valves.

20 Claims, 12 Drawing Sheets

(56) References Cited

U.S. PATENT DOCUMENTS

2008/0244818 A1* 10/2008 Li ..... E03D 1/306
4/393

* cited by examiner

RECONFIGURABLE FLAPPER FOR DIFFERENT SIZED FLUSH VALVES

CROSS-REFERENCE TO RELATED PATENT APPLICATIONS

This patent application claims the benefit of U.S. Provisional Patent Application No. 63/070,637, filed Aug. 26, 2020, the entire teachings and disclosure of which are incorporated herein by reference thereto.

FIELD OF THE INVENTION

This invention generally relates to flush valves for toilets and more particularly to the flapper of a flush valve.

BACKGROUND OF THE INVENTION

Conventional gravity-operated flush toilets have several basic components. The porcelain or china components include a bowl and a water tank mounted on top of a rear portion of the bowl. The bowl and tank can be separate pieces bolted together to form a two-piece toilet. Other gravity-operated flush toilets are made as a one-piece toilet in which the bowl and tank are made as one continuous integral piece of china.

More importantly, the plumbing components of a gravity-operated flush toilet include a fill valve in the tank which is connected to a water supply line, a drain hole in the bottom of the tank that communicates with the bowl, and a flush valve (also referred to as a flapper valve) that normally closes and seals the drain hole.

Flappers for flush valves are typically formed as a structure having a rim for sealing the drain hole with the flapper valve rim following flushing. The flapper is often formed of a soft elastomeric material and is hinged to allow the flapper to be pivotally moved upwardly and away from the drain hole by means of a chain that is connected to the flush handle on the outside of the tank. Once the tank sufficiently empties, the flapper then returns to a position where it seals the drain hole of the flush valve.

Such flush valve flappers are also typically formed to include a ballast structure which is a dome-like or cone-shaped structure that controls the buoyancy of the flapper. The buoyancy of a flapper is an important function because it determines how much or how little water is emptied from the tank upon flushing, thus creating water conservancy issues. The buoyancy of the flapper is determined by how quickly air is allowed to escape from the ballast.

Unfortunately, toilet flush valves come in different sizes. Two typical flush valve sizes are a 2" flush valve and a 3" flush valve. The principle differences between these two sizes is that the diameter of the drain hole and associated valve seat provided thereby, the size of the piping associated therewith, and the flow rate of water out of the drain hole. These features are typically smaller for the 2" flush valve as compared to the 3" flush valve.

Due to the differences in sizes, the legs for attaching the flapper to the rest of the flush valve are typically spaced further apart for the 3" flush valve than the 2" flush valve, the diameter of the seal for the 3" flush valve is typically larger than the seal for the 2" flush valve, and the flapper typically requires a larger amount of buoyancy for the 3" flush valve to prevent the larger flow of water from overwhelming the flapper and prematurely closing the flush valve.

One problem is thus that a single flapper is typically not conducive to being used with different sized flush valves.

BRIEF SUMMARY OF THE INVENTION

The present application provides improvements over the current state of the art as it relates to toilet flush valves and particularly flapper assembly kits for flush valves of different configurations.

In an example, a toilet flapper assembly kit includes a frame, first and second buoyancy assemblies and first and second seal members. The frame includes a main frame, a pair of adjustable legs and a buoyancy assembly attachment. The pair of adjustable legs adjustably attach to the main frame. The pair of legs are adjustable in at least one of a spacing between the legs or a length of the legs. The buoyancy assembly attachment attaches to the main frame. The buoyancy assembly attachment has a buoyancy assembly attachment interface. The first buoyancy assembly attaches to the buoyancy assembly attachment interface. The first buoyancy assembly provides a first amount of buoyancy when attached to the buoyancy assembly attachment. The second buoyancy assembly attaches to the buoyancy assembly attachment interface. The second buoyancy assembly provides a second amount of buoyancy when attached to the buoyancy assembly attachment. The second amount is different than the first amount. The first seal member has a first characteristic for sealing with a valve seat (e.g. for a drain hole) of a first size flapper valve assembly. The second seal member has a second characteristic for sealing with a valve seat of a second size flapper valve assembly. The second size is different than the first size.

In an example, a toilet flapper assembly kit includes a frame and first and second buoyancy assemblies attachable to the frame.

In a particular embodiment, the frame includes a main frame, a pair of adjustable legs and a buoyancy assembly attachment. The pair of adjustable legs adjustably attach to the main frame. The pair of legs are adjustable in at least one of a spacing between the legs or a length of the legs. The buoyancy assembly attachment attaches to the main frame. The buoyancy assembly attachment has a buoyancy assembly attachment interface. The first buoyancy assembly attaches to the buoyancy assembly attachment interface. The first buoyancy assembly provides a first amount of buoyancy when attached to the buoyancy assembly attachment. The second buoyancy assembly attaches to the buoyancy assembly attachment interface. The second buoyancy assembly provides a second amount of buoyancy when attached to the buoyancy assembly attachment. The second amount is different than the first amount.

In one example, the kit further includes first and second seal members. The first seal member has a first characteristic (e.g. size/shape/material) for sealing with a valve seat of a first size flapper valve assembly. The second seal member has a second characteristic for sealing with a valve seat of a second size flapper valve assembly. The second size being different than the first size.

In one example, a toilet flapper assembly kit includes a frame and first and second buoyancy assemblies is provided. The frame includes a buoyancy assembly attachment having a buoyancy assembly attachment interface. The first buoyancy assembly is attachable to the buoyancy assembly attachment interface. The first buoyancy assembly provides a first amount of buoyancy when attached to the buoyancy assembly attachment. The second buoyancy assembly attaches to the buoyancy assembly attachment interface. The second buoyancy assembly provides a second amount of buoyancy when attached to the buoyancy assembly attachment. The second amount is different than the first amount. In some embodiments, the buoyancy assembly attachment interface may have one feature for attaching the first buoyancy assembly and a second feature for attaching the second buoyancy assembly.

In one example, the toilet flapper assembly kit further includes first and second seal members having different sizes for use in different size flapper valve assemblies.

In one example, a toilet flapper assembly kit includes a frame, first and second buoyancy assemblies and first and second seal members. The frame includes a main frame, a pair of legs including a first leg and a second leg and a buoyancy assembly attachment. The pair of legs are adjustably attachable to the main frame in at least one of a spacing between the legs or a length of the legs. The buoyancy assembly attachment has a first buoyancy assembly attachment interface and a second buoyancy assembly attachment interface that is configured differently than the first buoyancy assembly attachment interface (e.g. size, shape or location). The first buoyancy assembly attaches to the first buoyancy assembly attachment interface. The first buoyancy assembly provides a first amount of buoyancy when attached to the buoyancy assembly attachment. The second buoyancy assembly attaches to the second buoyancy assembly attachment interface. The second buoyancy assembly provides a second amount of buoyancy when attached to the buoyancy assembly attachment. The second amount of buoyancy is different than the first amount. The first seal member attaches to the frame and has a first characteristic for sealing with a valve seat of a first size flapper valve assembly. A second seal member attaches to the frame and has a second characteristic for sealing with a valve seat of a second size flapper valve assembly. The second size being different than the first size.

In one example, the first buoyancy assembly attachment interface is a first annular undercut region and the first buoyancy assembly has a first radially extending annular project that snap engages with the first annular undercut region to secure the first buoyancy assembly to the buoyancy assembly attachment. The second buoyancy assembly attachment interface is a second annular undercut region and the second buoyancy assembly has a second radially extending annular project that snap engages with the second annular undercut region to secure the second buoyancy assembly to the buoyancy assembly attachment.

In one example, the first buoyancy assembly attachment interface has a first diameter and the second buoyancy assembly attachment interface has a second diameter that is different than the first diameter.

In one example, each leg of the pair of legs has a first end attached to the main frame and a second end configured to mount the leg to a support in a pivotable manner about a flapper pivot axis (typically provided by attachment posts of the flush valve). The buoyancy assembly attachment is attachable to the main frame between first and second orientations. The first buoyancy assembly attachment interface and the second buoyancy assembly attachment interface are spaced farther from the flapper pivot axis in the first orientation than in the second orientation.

In one example, the first and second buoyancy assembly attachment interfaces define a central axis and are axially offset from one another along the central axis.

In one example, the main frame and buoyancy assembly attachment have a pin and receiver connection interface including an attachment pin extending from one of the main frame and the buoyancy assembly attachment and an attachment pin receiver provided by the other one of the main frame and the buoyancy assembly attachment. The attachment pin or attachment pin receiver provided by the buoyancy assembly attachment is positioned in a non-rotation symmetric manner relative to a central axis of the buoyancy assembly attachment such that insertion of the attachment pin into the attachment pin receiver along an insertion axis with a first relative angular orientation about the insertion axis positions the first and second buoyancy attachment interfaces in a first position relative to the pair of legs and insertion of the attachment pin into the attachment pin receiver along the insertion axis with a second relative angular orientation about the insertion axis positions the first and second buoyancy attachment interfaces in a second position relative to the pair of legs.

In one example, the attachment pin is insertable into the attachment pin receiver in a discrete number of relative angular orientations about the insertion axis with at least two of the discrete number of relative angular orientations being angularly spaced apart about the insertion axis 180 degrees.

In one example, the attachment pin receiver has a non-circular inner periphery and the attachment pin has an alignment portion that has a non-circular outer periphery. The inner periphery of the attachment pin receiver and outer periphery of the alignment portion engage to inhibit angular motion between the main frame and buoyancy assembly attachment when engaged.

In one example, the buoyancy assembly attachment includes a first key and a second key. The first buoyancy assembly has a third key that engages the first key when the first buoyancy assembly is attached to the buoyancy assembly attachment. The second buoyancy assembly has a fourth key that engages the second key when the second buoyancy assembly is attached to the buoyancy assembly attachment. The engagement of the first and third keys orients the first buoyancy assembly at a different angular orientation about a central axis of the buoyancy assembly attachment than the angular orientation of the second buoyancy assembly about the central axis when the second and fourth keys engage.

In one example, one of the first key and the third key is a first notch and the other one of the first key and the third key is a first projection. One of the second key and the fourth key is a second notch and the other one of the second key and fourth key is a second projection.

In one example, the first characteristic is an outer diameter of the first seal member. The second characteristic is an outer diameter of the second seal member. The second diameter being different than the first diameter.

In one example, the main frame and the buoyancy assembly attachment are formed as a one-piece, unitary body formed from a continuous piece of material.

In one example the first buoyancy assembly has a first volume and the second buoyancy assembly has a second volume that is less than the first volume.

In one example, the frame includes a seal mounting groove that opens in a radially outward direction. The bottom (e.g. radially innermost surface) of the mounting groove has a groove diameter. The first and second seal members each has an inner diameter that is substantially equal to the groove diameter such that the first seal member may be mounted to the frame within the mounting groove or the second seal member may be mounted to the frame within the mounting groove.

In one example, the mounting groove is provided by the buoyancy assembly attachment.

In one example, the frame includes first and second pairs of leg mounting features. Each pair including an inner leg mounting feature and an outer leg mounting feature. The first and second pairs of leg mounting features are laterally spaced apart. The first and second inner leg mounting features being positioned laterally between the first and second outer leg mounting features. The first leg has a first cooperating feature configured to engage, selectively, the first inner and outer leg mounting features to vary a position of the first leg relative to the frame. The second leg has a second cooperating feature configured to engage, selectively, the second inner and outer leg mounting features to vary a position of the second leg relative to the frame. The first inner and outer leg mounting features are first male connectors and the first cooperating feature is a first female connector. Each first male connector has an anti-rotation boss, an offset boss, and an oblong head portion. The offset boss is interposed between the anti-rotation boss and the oblong head portion. Each first male connector defines a first leg mounting axis. The first female connector includes an opening having an anti-rotation region having an inner periphery sized and shaped to engage the anti-rotation bosses to inhibit rotation of the first leg relative to the frame about the first leg mounting axis absent elastic deformation of one or both of the anti-rotation boss or the anti-rotation region. The first female connector includes a throat region offset from or provided by the anti-rotation region having an oblong cross-section sized and/or shaped to receive the oblong head therethrough when the first leg is in a first angular orientation about the first leg mounting axis relative to the frame and sized and/or shaped to prevent the oblong head from passing therethrough when the first leg is in a second angular orientation about the first leg mounting axis relative to the frame. The second inner and outer leg mounting features are second male connectors and the second cooperating feature is a second female connector. Each second male connector has an anti-rotation boss, an offset boss, and an oblong head portion. The offset boss is interposed between the anti-rotation boss and the oblong head portion. Each second male connector defines a second leg mounting axis. The second female connector includes an opening having an anti-rotation region having an inner periphery sized and shaped to engage the anti-rotation bosses to inhibit rotation of the second leg relative to the frame about the second leg mounting axis absent elastic deformation of one or both of the anti-rotation boss or the anti-rotation region. The second female connector includes a throat region offset from or provided by the anti-rotation region having an oblong cross-section sized and/or shaped to receive the oblong head therethrough when the second leg is in a first angular orientation about the second leg mounting axis relative to the frame and sized and/or shaped to prevent the oblong head from passing therethrough when the second leg is in a second angular orientation about the second leg mounting axis relative to the frame.

In an example, a method of assembling a flapper assembly is provided. The method includes providing a flapper assembly kit as outlined above. The method includes attaching the first and second legs to the frame with a selected spacing therebetween. The method includes selecting one of the first or second buoyancy assemblies. The method includes attaching the selected one of the first or second buoyancy assemblies to the frame.

In one example, the method includes selecting one of the first or second seal members. The method includes attaching the selected one of the first or second seal members to the frame.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
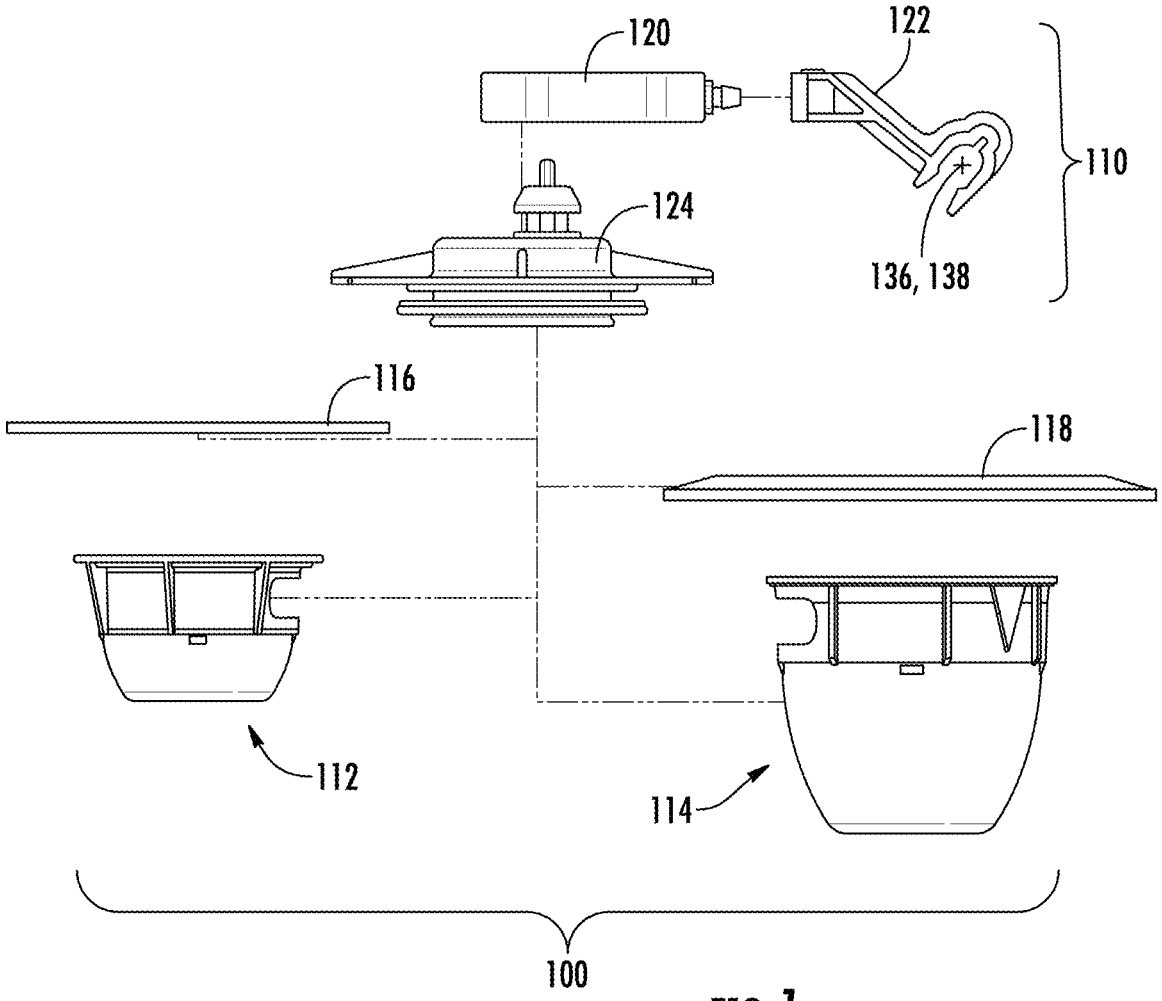
FIG. 1 is an exploded illustration of a flapper assembly kit for use in toilet flush valves.
Figure 3:
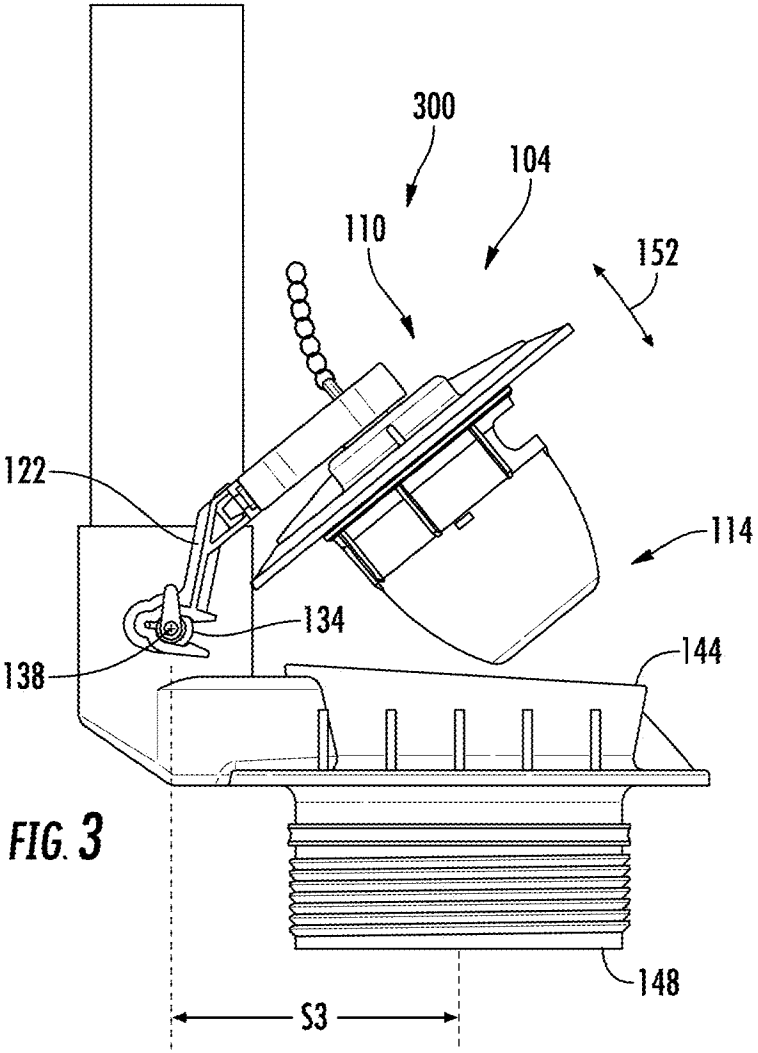
FIG. 3 is a side view illustration of a toilet flush valve of a second size.
Figure 2:
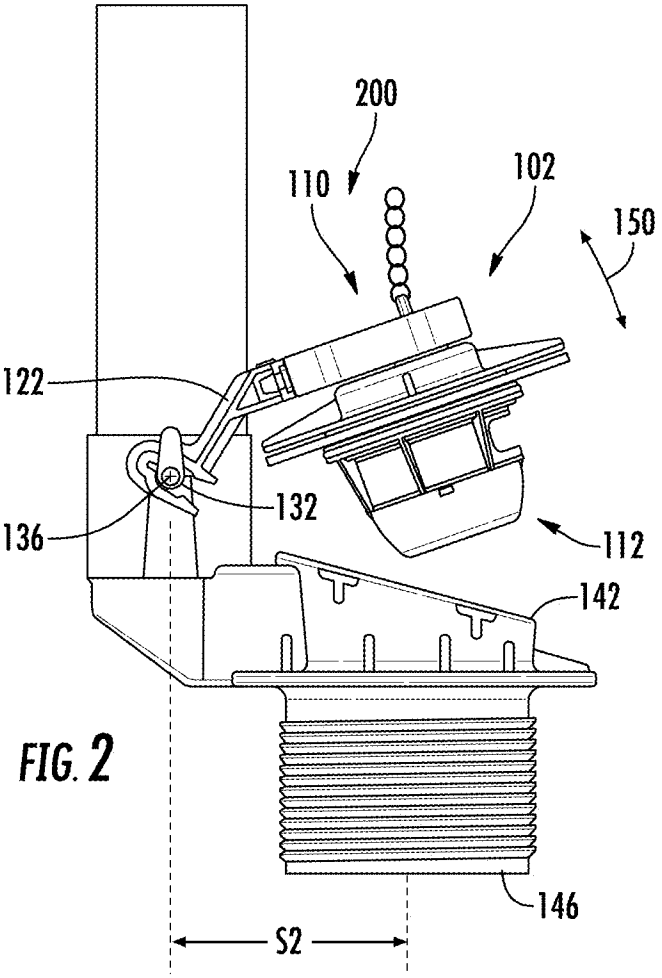
FIG. 2 is a side view illustration of a toilet flush valve of a first size.
Figure 5:
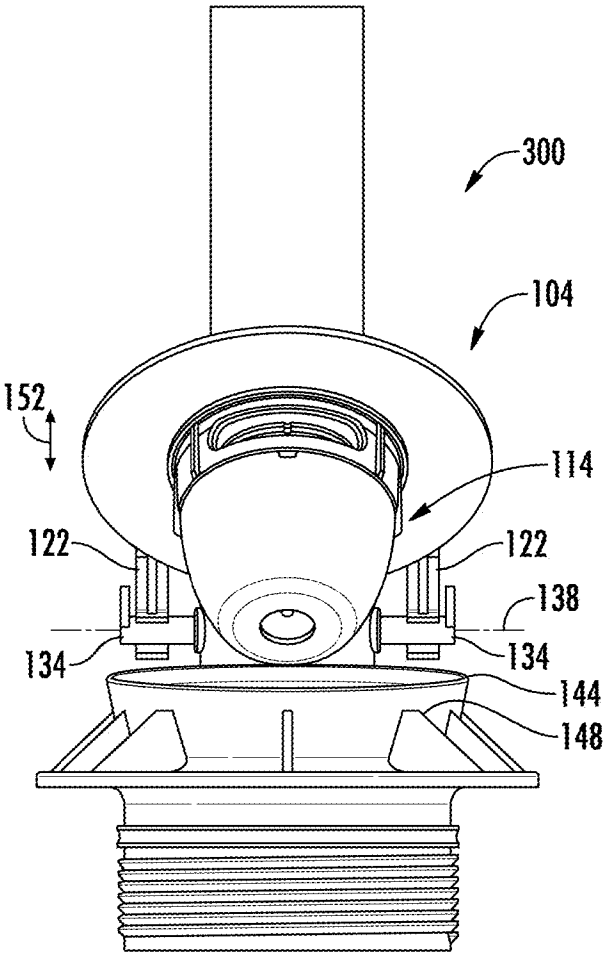
FIG. 5 is a front illustration of the toilet flush valve of FIG. 3.
Figure 4:
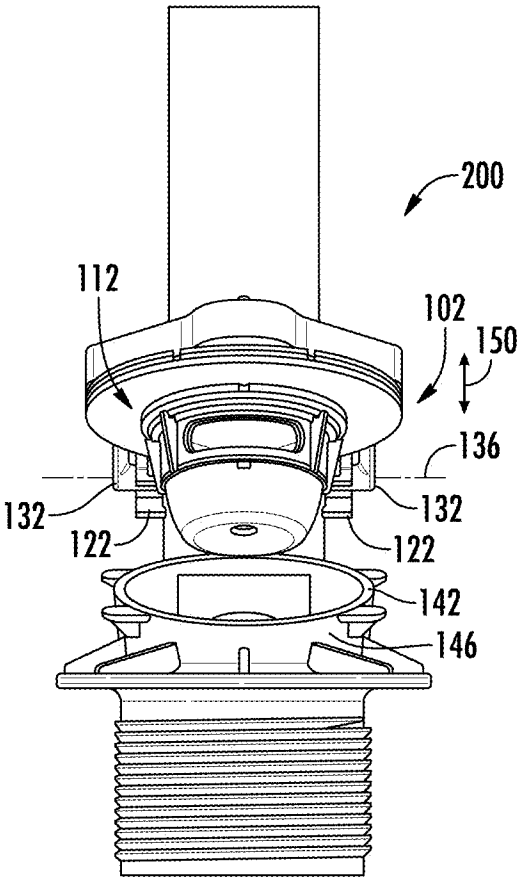
FIG. 4 is a front illustration of the toilet flush valve of FIG. 2.
Figure 6:
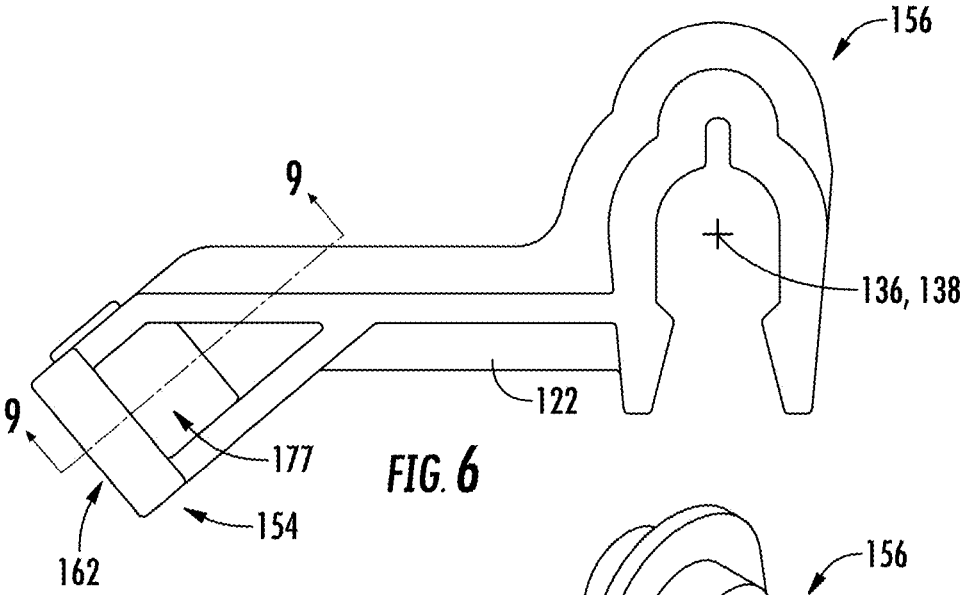
FIG. 6 is a side view of a leg of the flapper assembly kit of FIG. 1.
Figure 7:
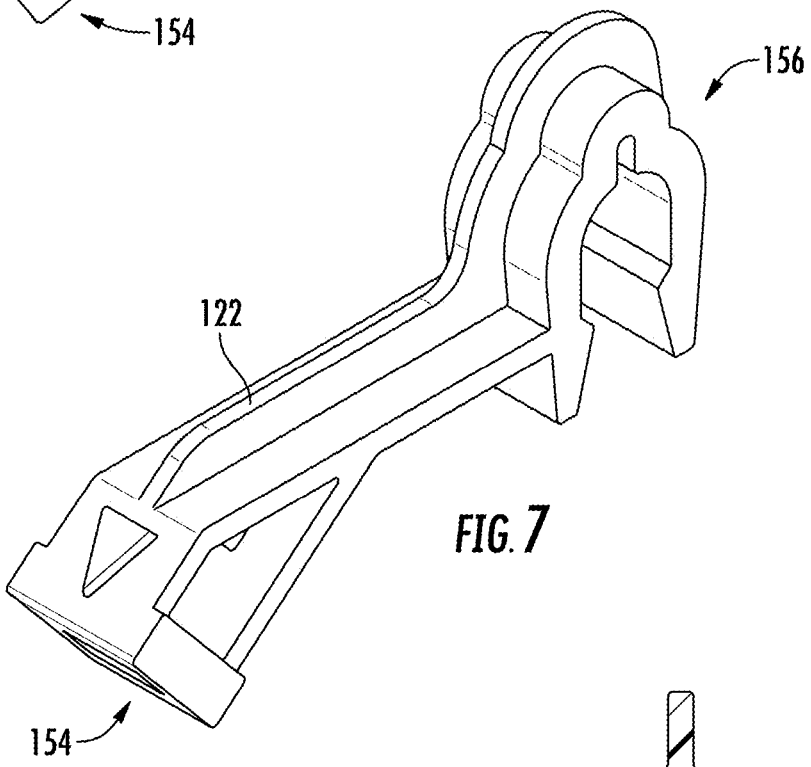
FIG. 7 is a perspective view of the leg of FIG. 6.

FIG. 1 illustrates a flapper assembly kit 100 for use in toilet flush valves. The flapper assembly kit 100 allows for a single kit to be provided for different sized toilet flush valves. For example, the flapper assembly kit 100 can be configured to provide a flapper assembly 102 for a 2" flush valve 200 (FIGS. 2 and 4) or configured to provide a flapper assembly 104 for a 3" flush valve 300 (FIGS. 3 and 5). While 2" and 3" flush valves 200, 300 are referenced herein, other size flush valves could be incorporated into the flapper assembly kit 100.

With reference to FIG. 1, the flapper assembly kit 100 includes a frame 110, a first buoyancy assembly 112 (also referred to as a ballast), a second buoyancy assembly 114 (also referred to as a ballast), a first seal member 116 and a second seal member 118.

In this embodiment, the frame 110 includes a main frame member 120 (also referred to simply as a main frame 120), first and second legs 122 (only one of which is illustrated in FIG. 1) and a buoyancy assembly attachment 124 (also referred to as a top cone 124). While these components are illustrated as separate components in this kit, various ones or all of these components, in other embodiments, could be combined into single component formed from a single continuous piece of material. For example, some embodiments may have the main frame member 120 and the top cone 124 formed as a single component. Alternative embodiments, could have the main frame member 120 and the legs 122 formed as a single component.

With additional reference to FIGS. 2-5), the legs 122 pivotally connect the flapper assembly 102, 104 to attachment posts 132, 134 for motion about flapper pivot axes 136, 138, respectively. This allows the user to open the flush valve 200, 300 by pivoting the flapper assembly 102, 104 away from the corresponding valve seats 142, 144 of corresponding valve bodies 146, 148, illustrated by arrows 150, 152.

FIGS. 6-9 illustrate a single leg 122. While two legs are provided in a flapper assembly 102, 104, the legs 122 are identical so a single leg only need be described. Leg 122 extends between a first end 154 configured for selective attachment to the main frame 120 and a second end 156 for attachment to the attachment posts 132, 134. In this embodiment, the second end 156 can be resiliently snap attached to attachment posts 132, 134 as well as to allow for the pivotal motion of the flapper assembly 102, 104, once attached to the attachment posts 132, 134.

Figure 10:
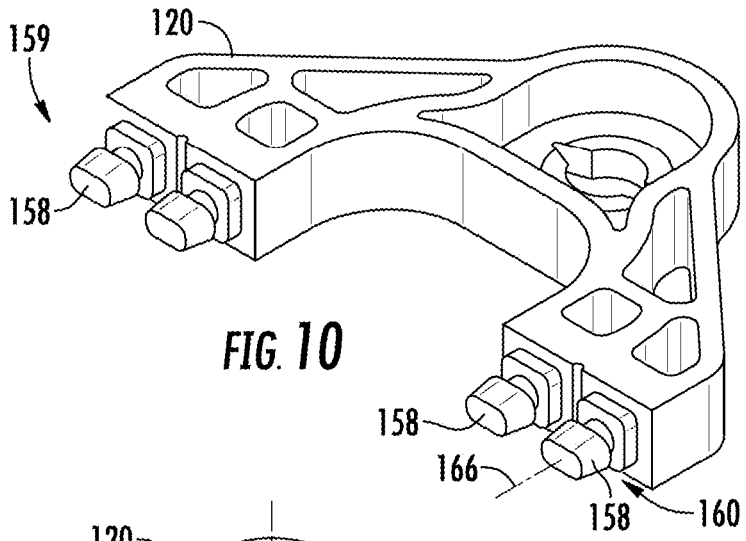
FIG. 10 is a perspective view of a main frame member of the flapper assembly kit of FIG. 1.
Figure 11:
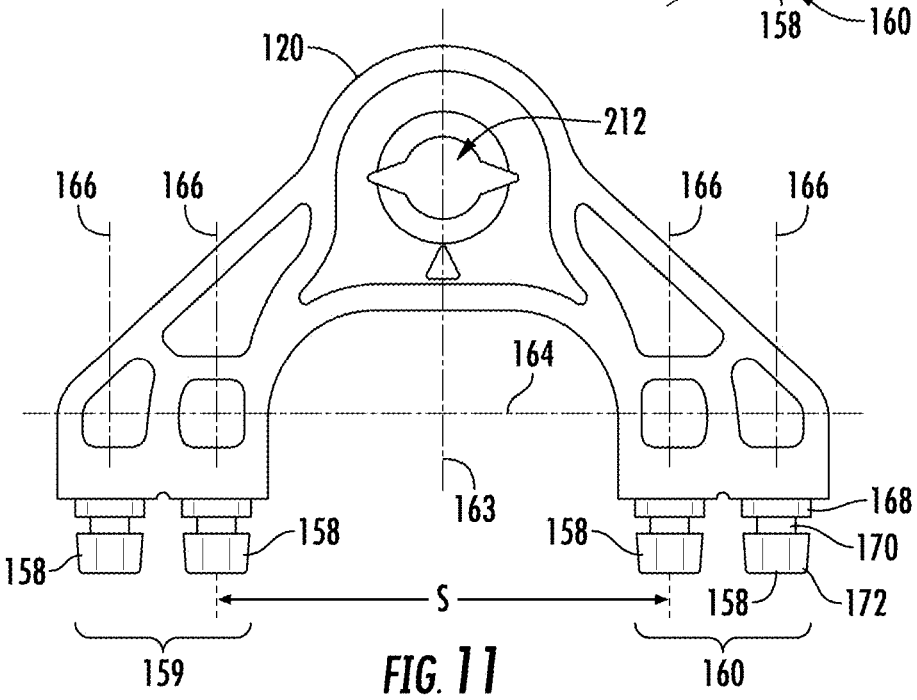
FIG. 11 is a top view illustration of the main frame member of FIG. 10.
Figure 12:
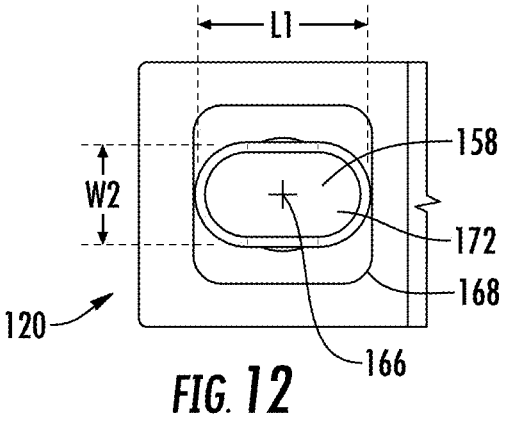
FIG. 12 is a partial rear view illustration of the main frame member of FIG. 10.
Figure 13:
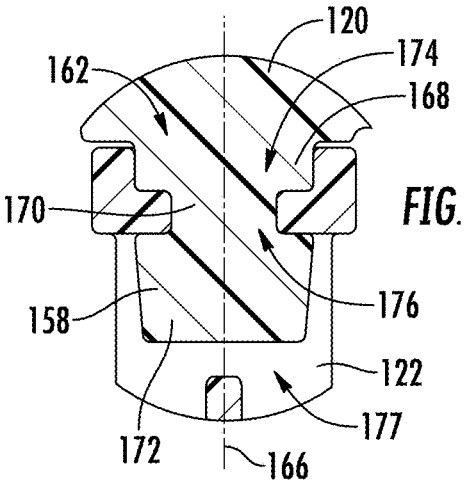
FIG. 13 is a cross-sectional illustration of a leg of FIG. 6 connected to the main frame member of FIG. 10.

FIGS. 10-12 illustrate the main frame member 120. The main frame member 120 includes a plurality of leg mounting features 158 (also referred to herein as male connectors 158) forming first and second pairs of leg mounting features 159, 160 (one pair for one leg and the other pair for the other leg). Each leg 122 has a cooperating mounting feature 162 (also referred to herein as female connectors 162) proximate the first end 154 that can be selectively engaged with the leg mounting features 158.

In this embodiment, the main frame 120 is symmetrical along a center line 163 (FIG. 11) and the first and second pairs of leg mounting features 159, 160 are laterally spaced apart along axis 164 that is perpendicular to center line 163. Further, within a particular pair 159, 160, the leg mounting features 158 are laterally spaced apart from one another along axis 164 defining inner and outer mounting features (e.g. inner mounting features are closer to center line 163 and the inner mounting features 158 are located latterly between the outer mounting features). The lateral spacing provided by the leg mounting features 158 provides different spacing S between the second ends 156 of the legs 122 to accommodate different sized pipes/valve bodies 146, 148 from which posts 132, 134 extend (see e.g. FIGS. 2-5).

In this embodiment, the leg mounting features 158 are male connectors 158 in the form of axially extending pins.

Each male connector 158 defines a leg mounting axis 166 along which a leg 122 receives the male connector 158 during assembly. Each male connector 158, in this example, includes an anti-rotation boss 168, an offset boss 170 and an oblong head portion 172. The offset boss 170 offsets the anti-rotation boss 168 from the oblong head portion 172.

With reference to FIGS. 8-10, 12 and 13, the anti-rotation boss 168 has a non-circular outer periphery that cooperates with a corresponding anti-rotation region 174 of the female connectors 162 of the legs 122. The anti-rotation region 174 of the female connectors 162, in this example, have a square inner periphery that is sized and shaped to engage with the outer periphery of the anti-rotation boss 168. This non-circular engagement inhibits undesirable rotation of the legs 122 relative to the main frame 120 about leg mounting axis 166. In some embodiments, the anti-rotation boss 168 and anti-rotation region 174 are configured to allow for plastic deformation so that the legs 122 can be rotated relative to the main frame 120 upon the application of sufficient torque, but not under normal use once assembled in the flush valve 200, 300.

Figure 8:
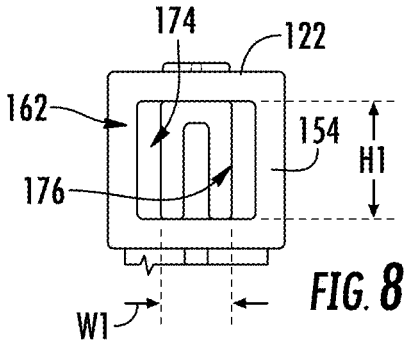
FIG. 8 is an end view of the leg of FIG. 6.
Figure 9:
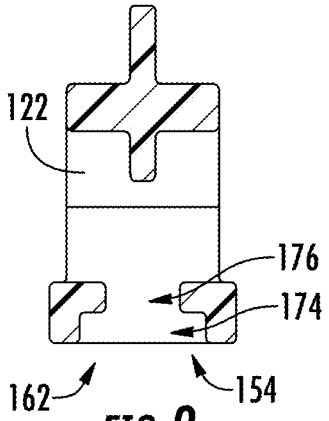
FIG. 9 is a cross-sectional illustration of a portion of the leg of FIG. 6 taken about line 9-9.

The oblong head portion 172 prevents axial disengagement of the female connectors 162 of legs 122 from the male connectors 168 of the main frame member 120. More particularly, the female connector 162 includes a throat region 176 that is sized and shaped to receive the oblong head portion 172 therethrough in a first angular orientation about axis 166 of the legs 122 relative to the main frame member 120, but that prevents axial removal of the oblong head portion 172 therethrough in a second angular orientation about axis 166 of the legs 122 relative to the main frame 120. As illustrated in FIG. 8, the height H1 of the throat region 176 is greater than the width W1 such that the throat region 176 is oblong as well. Similarly, the length L1 of the oblong head portion 172 is greater than width W2 of the oblong head portion 172. Notably, the length L1 is greater than the width W1 of the throat region 176. Thus, when the width W1 is aligned with the length L1, the oblong head portion 172 cannot pass through the throat region 176.

Notably, the female connectors 162 have an enlarged region 177 that is sized to allow for rotation of the oblong head portion 172 therein about axis 166.

Therefore, to attach a leg 122 to the main frame member 120, the user aligns the oblong head portion 172 with the throat region 176, inserts the male connector 158 into the female connector 162 with the head portion 172 past the throat region 176 and then rotates the leg about axis 166. When properly axially inserted, the anti-rotation boss 168 will be received in the anti-rotation region 174 and sufficient force will need to be applied to cause elastic deform of one or both of the main frame member 120 or the leg 122 to allow for the rotation. Once properly rotated, the leg 122 will be locked to the main frame member 120.

As will be appreciated, the user will select which male connectors 158 to attach the legs 122 (e.g. both legs will typically be mounted to the outer male connectors 158 for larger flush valves while both legs will typically be mounted to the inner male connectors 158 for smaller flush valves).

The legs 122 may have indicia such as arrows that aligns with indicia such as numbers on the main frame member 120 when the legs 122 are properly oriented relative to the main frame member 120 to indicate to the user which configuration the legs 122 are in.

In some embodiments, the throat region 176 could provide both the anti-rotation region 174 as well as the throat region 176 and the offset boss 170 could provide the anti-rotation boss 168. For example rather than having a round periphery, it could have a non-round periphery that engages the inner periphery of the throat region 176 and inhibits rotation as outlined above.

Further, in other examples, the male connectors and female connectors could be reversed. More particularly, the legs 122 could provide the male connectors while the main frame 120 could provide the female connectors.

With reference to FIGS. 14-17, the buoyancy assembly attachment 124 allows for the selective attachment of either buoyancy assembly 112 or buoyancy assembly 114. In this example, the buoyancy assembly attachment 124 includes a first buoyancy assembly attachment interface 178 for attaching buoyancy assembly 112 and a second buoyancy assembly attachment interface 180 for attaching buoyancy assembly 114. In this example, the first and second buoyancy assembly attachment interfaces 178, 180 are provided by radially extending annular projections that form undercut regions 182, 184, respectively.

In this example, the first and second buoyancy assembly attachment interfaces 178, 180 are axially offset from one another along central axis 214 defined by the buoyancy assembly attachment 124. Further, in this example, the first and second buoyancy assembly attachment interfaces 178, 180 are concentric about central axis 214.

Figure 14:
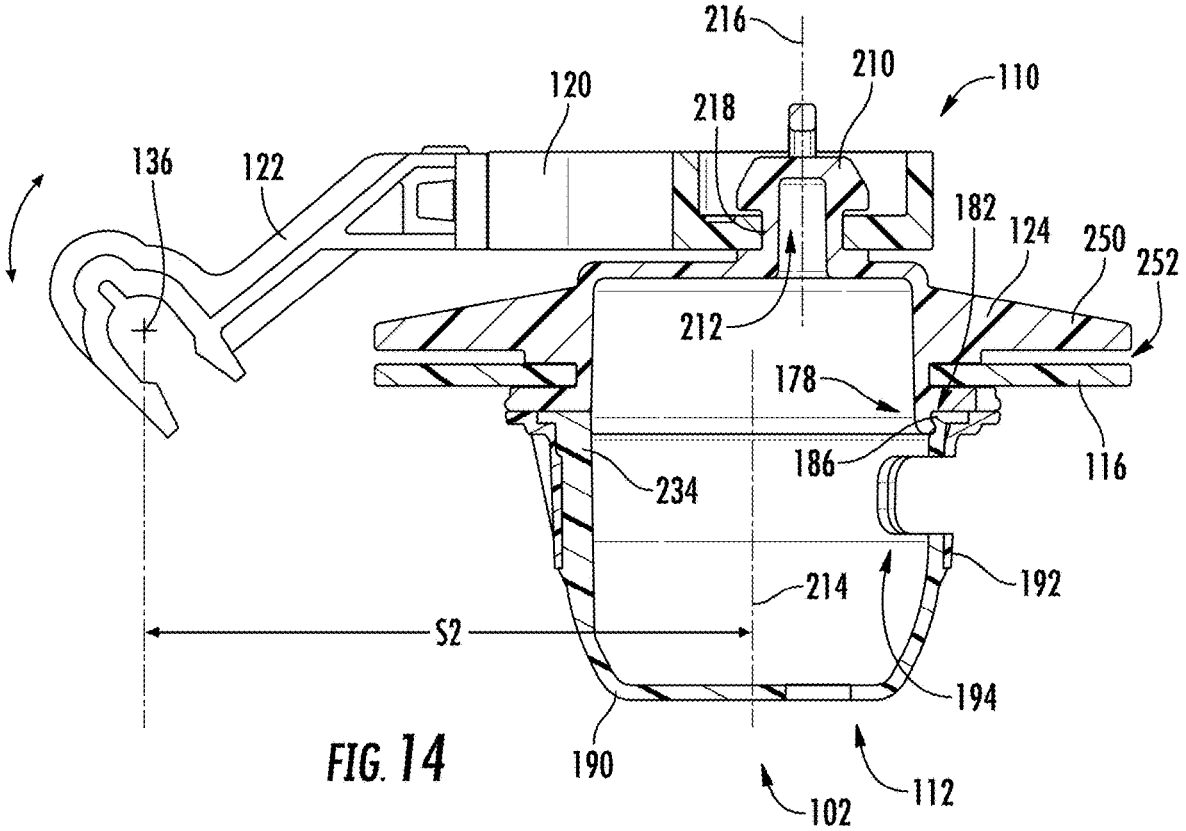
FIG. 14 is a cross-sectional illustration of a flapper assembly in a first configuration provided by the flapper assembly kit of FIG. 1.
Figure 15:
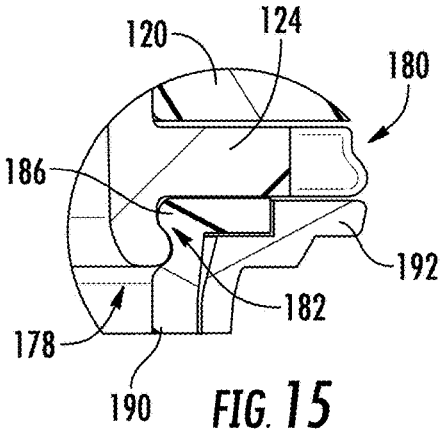
FIG. 15 is an enlarged cross-sectional illustration of a portion of FIG. 14.

The buoyancy assembly 112 includes a radially extending projection 186 that extends into the undercut region 182 to secure buoyancy assembly 112 to the frame 110, and particularly to buoyancy assembly attachment 124 (see FIGS. 14 and 15). Similarly, buoyancy assembly 114 includes a radially extending projection 188 that extends into the undercut region 184 to secure buoyancy assembly 114 to the frame 110, and particularly to buoyancy assembly attachment 124.

Figures 16, 17:
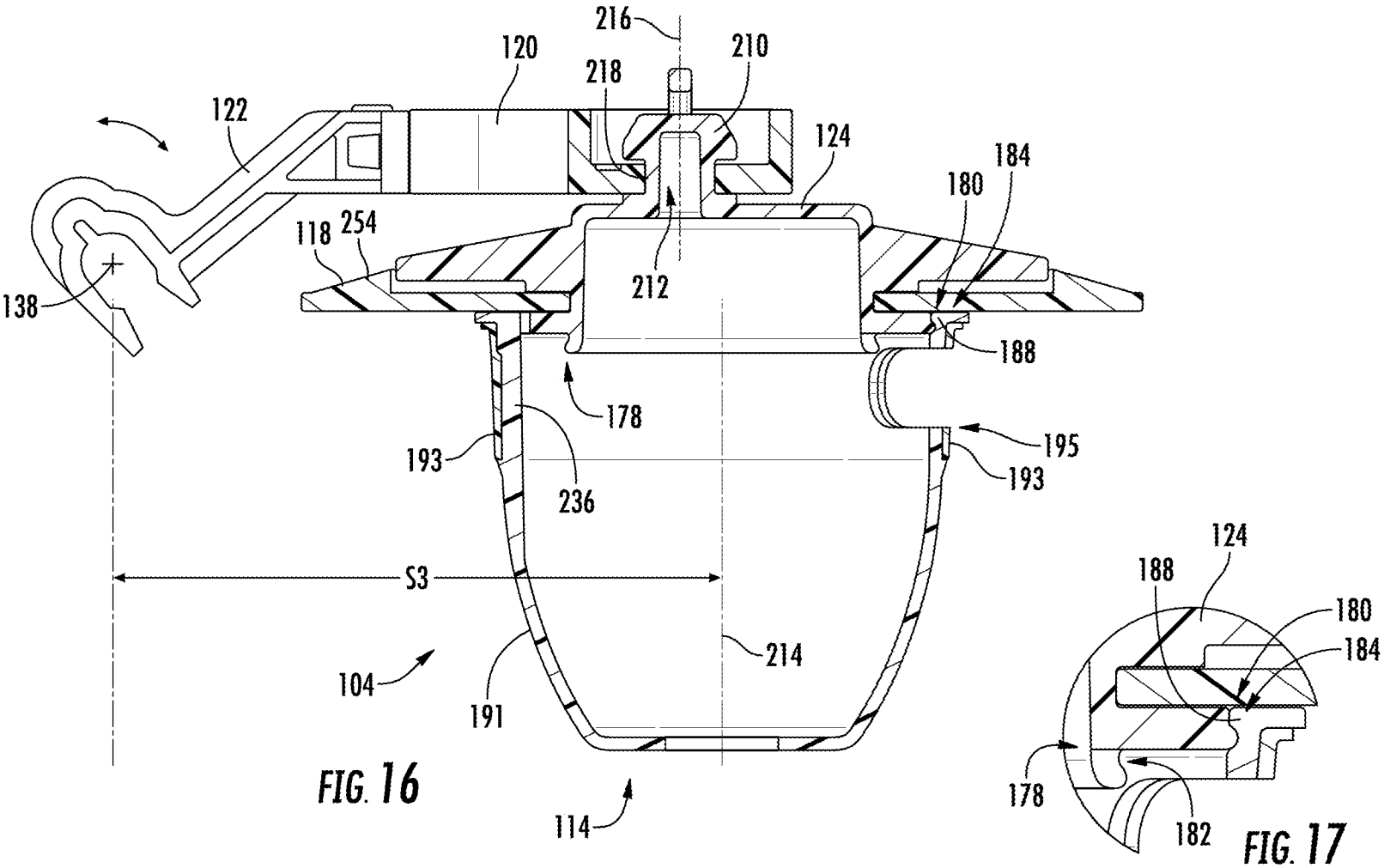
FIG. 16 is a cross-sectional illustration of a flapper assembly in a second configuration provided by the flapper assembly kit of FIG. 1.
FIG. 17 is an enlarged cross-sectional illustration of a portion of FIG. 16.
Figure 19:
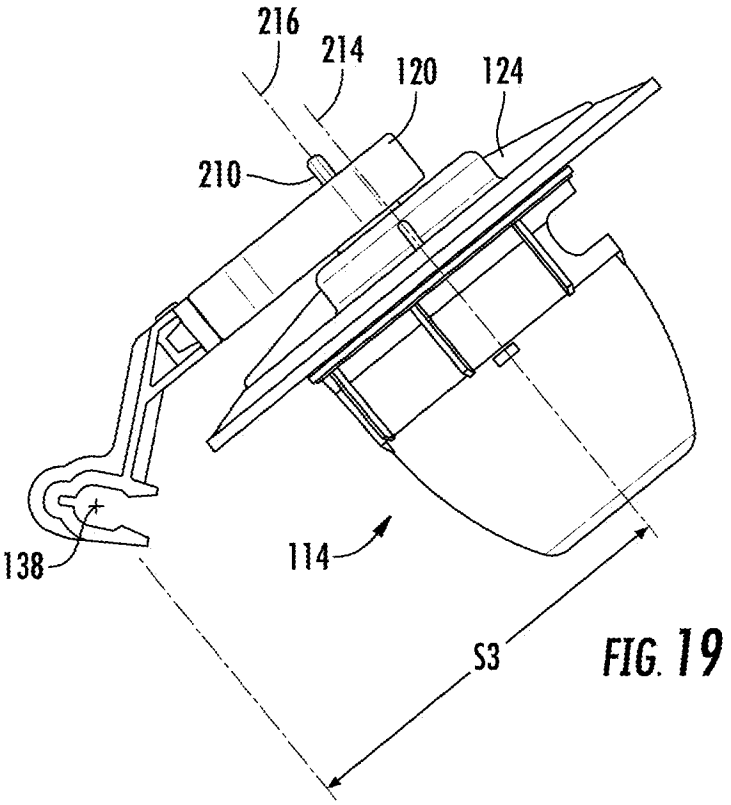
FIG. 19 is a side view illustration of the flapper assembly of FIG. 16.
Figure 18:
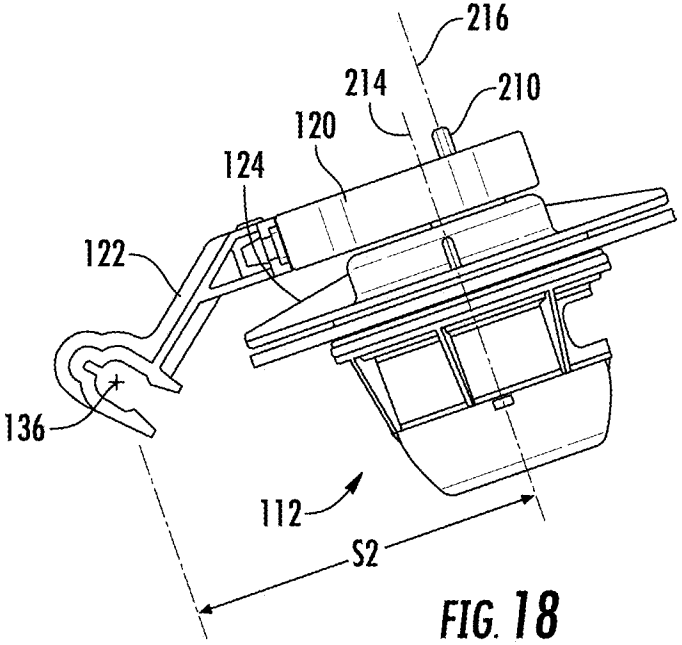
FIG. 18 is a side view illustration of the flapper assembly of FIG. 14.

With reference to FIGS. 14 and 16, the buoyancy assemblies 102, 104 are similar in operation, but have different buoyancy characteristics. In this example, the buoyancy of each of the buoyancy assemblies 102, 104 is adjustable, however, this is not required of all embodiments. The adjustability of the buoyancy can be accomplished in many ways. In the illustrated embodiment, each buoyancy assembly 112, 114 has a hollow cone 190, 191 and an adjustment band 192, 193 that adjust the flow rate of air out of apertures 194, 195 of the hollow cone 190, 191.

In this embodiment, the hollow cones 190, 191 provide the annular projections 186, 188.

The material of one or both of the cones 190, 191 and the buoyancy assembly attachment interfaces 178, 180 is configured to allow for elastic deformation such that the buoyancy assemblies 102, 104 can be snap attached to the buoyancy assembly attachment interfaces 178, 180.

In addition to differences in the spacing between the legs 122 so as to be able to straddle/accommodate different sized the pipe or valve bodies of the flush valves, the required offset of the seal members 116, 118 and/or the buoyancy assemblies 112, 114 from the attachment posts 132, 134 and/or pivot axes 136, 138 can vary to allow for proper seating of the seal members 116, 118 with the corresponding valve seats 142, 144. This difference in spacing S2 and S3 is illustrated in representative fashion by spacing S2 and S3 in FIGS. 2, 3, 14, 16, 18, and 19.

In this example, the main frame member 120 and buoyancy assembly attachment 124 have a pin and receiver connection interface including an attachment pin 210 extending from the buoyancy assembly attachment 124 and an attachment pin receiver 212 provided by the main frame member 120. The attachment pin 210 provided by the buoyancy assembly attachment 124 is positioned in a non-rotation symmetric manner relative to a central axis 214 of the buoyancy assembly attachment 124. As such, insertion of the attachment pin 210 into the attachment pin receiver 212 along an insertion axis 216 with a first relative angular orientation about the insertion axis 216 positions the first and second buoyancy attachment interfaces 178, 180 in a first position relative to the pair of legs 122 and insertion of the attachment pin 210 into the attachment pin receiver 212 along the insertion axis 216 with a second relative angular orientation about the insertion axis 216 positions the first and second buoyancy attachment interfaces 178, 180 in a second position relative to the pair of legs 122.

Figure 20:
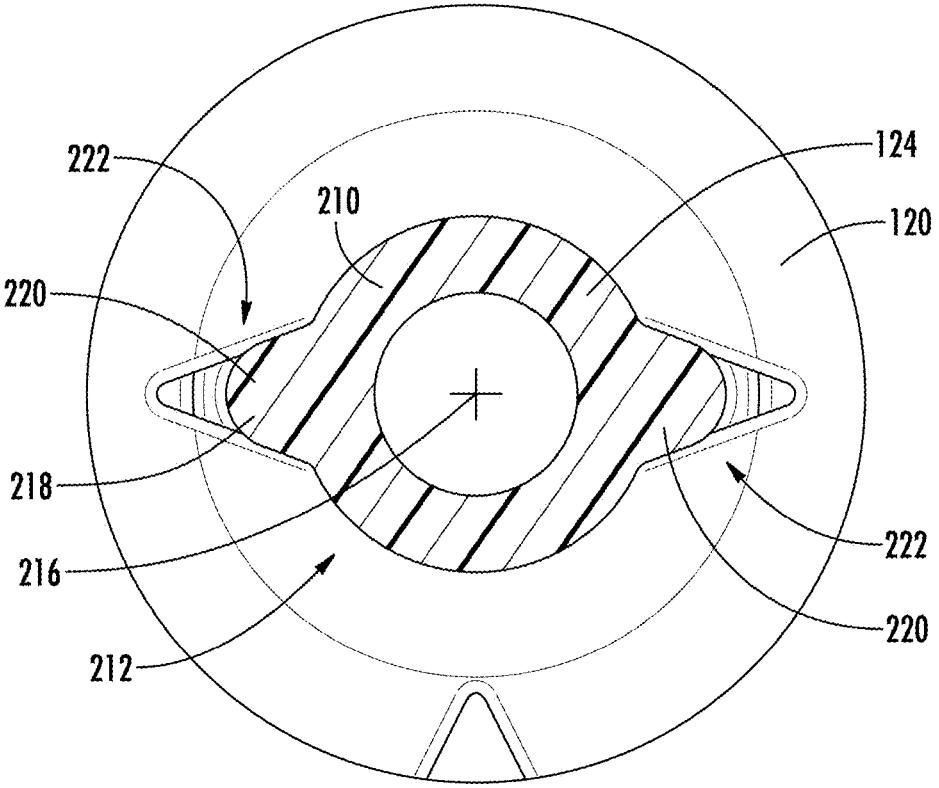
FIG. 20 is a cross-sectional illustration of the base frame member attached to a buoyancy assembly attachment.
Figure 21:
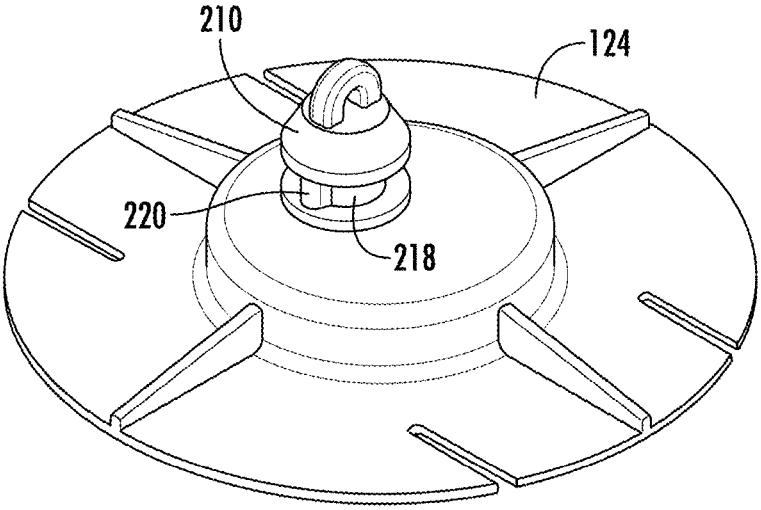
FIG. 21 is a top perspective illustration of the buoyancy assembly attachment of the kit of FIG. 1.

With reference to FIG. 20, preferably, the attachment pin 210 is insertable into the attachment pin receiver 212 in a discrete number of relative angular orientations about the insertion axis 216. While not required, in one example, at least two of the discrete number of relative angular orientations are angularly spaced apart about the insertion axis by 180 degrees.

To provide the discrete number of relative angular orientations, the attachment pin receiver 212 has a non-circular inner peripheral shape and the attachment pin 210 has an alignment portion 218 that has a non-circular outer periphery. The inner periphery of the attachment pin receiver 212 and outer periphery of the alignment portion 218 engage to inhibit angular motion between the main frame member 120 and buoyancy assembly attachment 124 when engaged.

In the illustrated embodiment, the alignment portion 218 has ribs 220 that engage notches 222 in the inner periphery of the attachment pin receiver 212. In this example there are two notches 222 and two ribs 220 provided such that there are two relative angular orientations provided by the pin and receiver connection interface.

Other arrangements other than the use of ribs and notches is contemplated. Further, more than two discrete angular orientations between the attachment pin receiver 212 and attachment pin 210 are contemplated.

Figure 23:
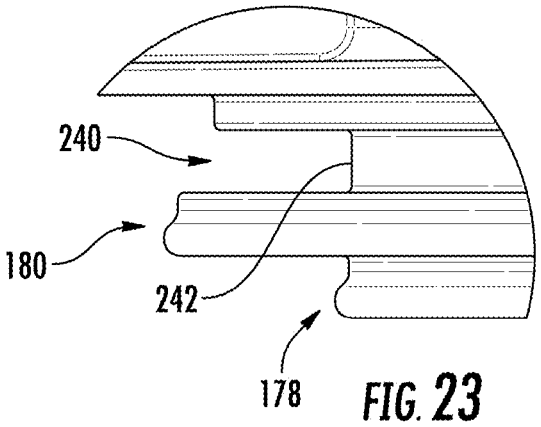
FIG. 23 is an enlarged illustration of a portion of FIG. 22.
Figure 24:
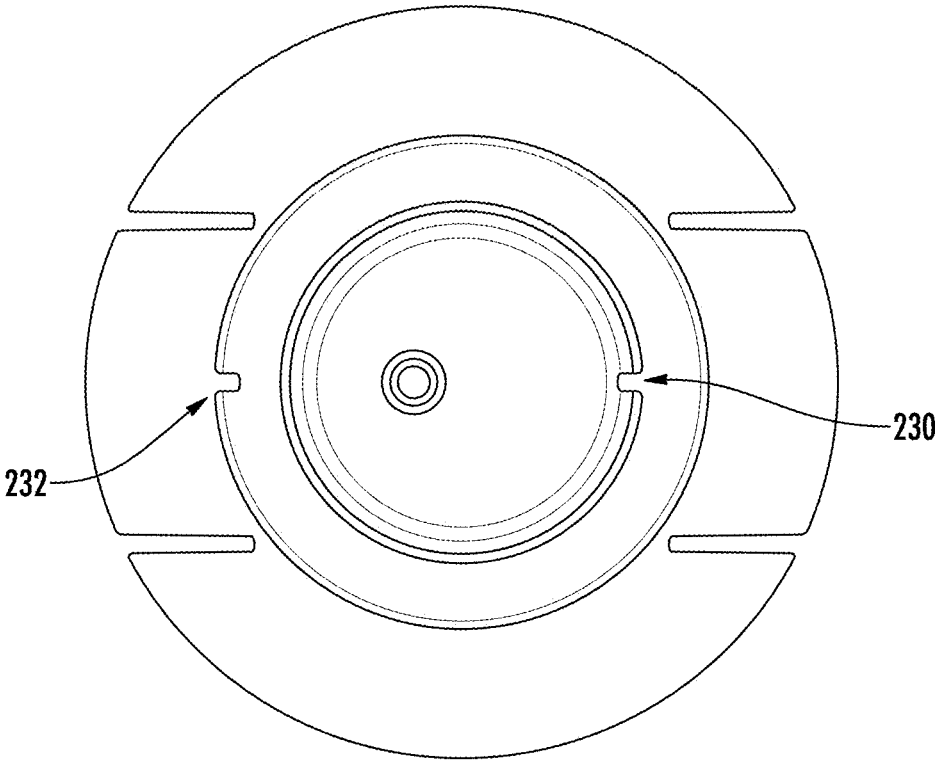
FIG. 24 is a bottom illustration of the buoyancy assembly attachment of FIG. 21.

With reference to FIGS. 14, 16, 24-26, to angularly clock, the first and second buoyancy assemblies 112, 114 relative to the buoyancy assembly attachment 124 about axis 214, the buoyancy assembly attachment 124 includes first and second keys 230, 232 (FIG. 23) and the first buoyancy assembly 112 has a third key 234 (FIG. 14) that angularly engages the first key 230 and the second buoyancy assembly 114 has a fourth key 236 (FIG. 16) that angularly engages the second key 232.

In the illustrated example, the first and second keys 230, 232 are in the form of notches proximate the first and second buoyancy assembly attachment interfaces 178, 180 and the third and fourth keys 234, 236 are projections provided the hollow cones 190, 191 that extend into the notches. The angular clocking allows a user to properly orient the various apertures (e.g. apertures 194, 195 as well as bottom holes) within the hollow cones 190, 191 relative to the pivot axes 136, 138 to provide proper air flow/buoyancy.

Figure 25:
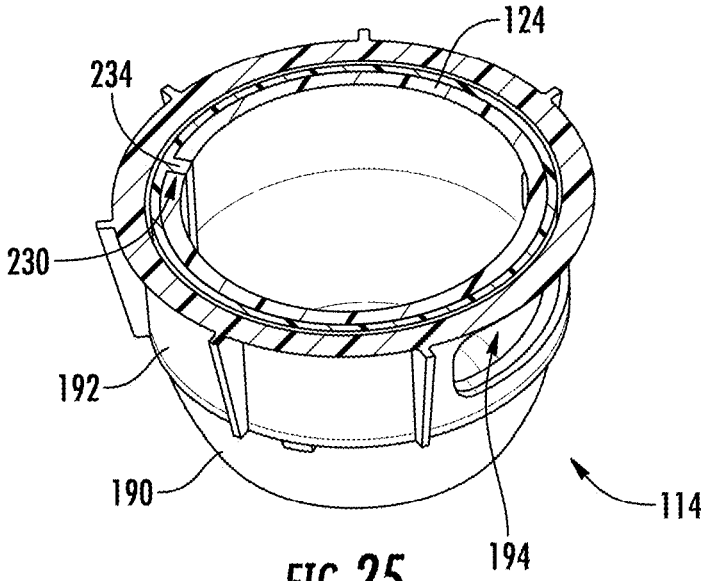
FIG. 25 is a cross-sectional illustration of the flapper assembly of FIG. 14 showing engagement of keys between the cone thereof and the buoyancy assembly attachment.
Figure 26:
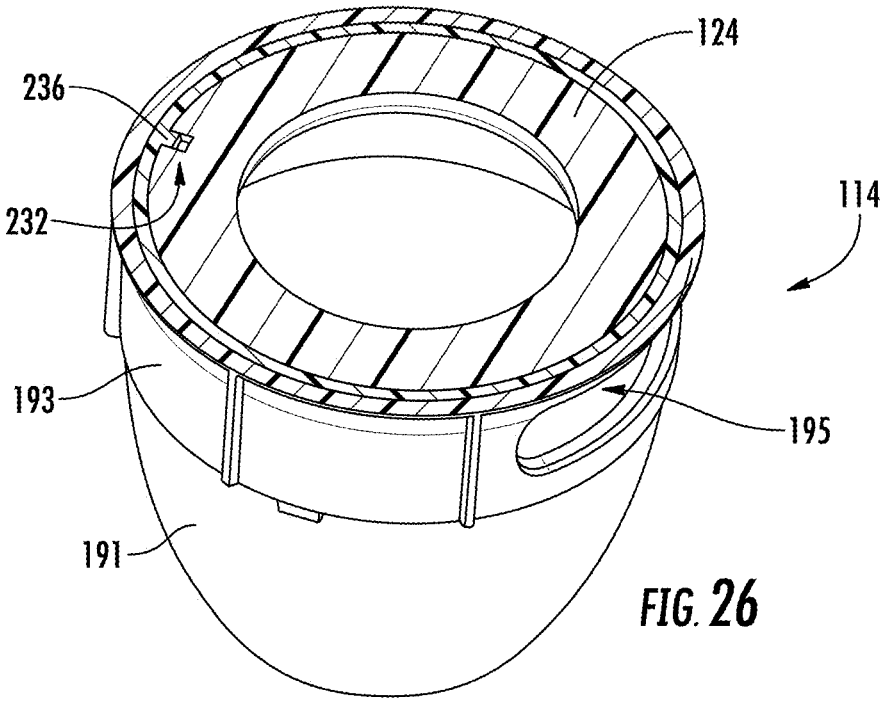
FIG. 26 is a cross-sectional illustration of the flapper assembly of FIG. 16 showing engagement of keys between the cone thereof and the buoyancy assembly attachment.

FIGS. 25 and 26 are cross-sectional illustrations that illustrate the first and second keys 230, 232 engaged with corresponding third and fourth keys 234, 236. Notably, the first and second keys are angularly offset from one another about a central axis, e.g. axis 214, of the buoyancy assembly attachment 124. Preferably, they are angularly offset by 180 degrees. This corresponds to the clocking provided between the base member 120 and the buoyancy assembly attachment 124. More particularly, this relates to the engagement and angular orientations discussed previously related to ribs 220 and notches 222.

In the illustrated, and preferred embodiment, the keys 230, 232, 234, 236 are configured such that the apertures 194, 195 of the buoyancy assemblies 112, 114 face away from axes 136, 138 when assembled. This provides a more consistent air evacuation from cones 190, 191 during a flush cycle. For example, when a user initiates a flush, the flapper assemblies 102, 104 will have the apertures 194, 195 facing upwards rather than downward to allow for the consistent flow air out of the cones 190, 191, rather than downwards causing the air to flow around the flapper assembly 102, 104 as it flows upwards after exiting apertures 194, 195.

In other embodiments, rather than having keys 234, 236 angularly offset from one another, in some embodiments, the cones 190, 191 could have their corresponding cones offset from one another 190 degrees. More particularly, for example, key 234 of cone 190 could be in the same location, but key 236 of cone 191 could be moved 180 degrees about the central axis of the cone such that it is located adjacent opening 195.

Figure 22:
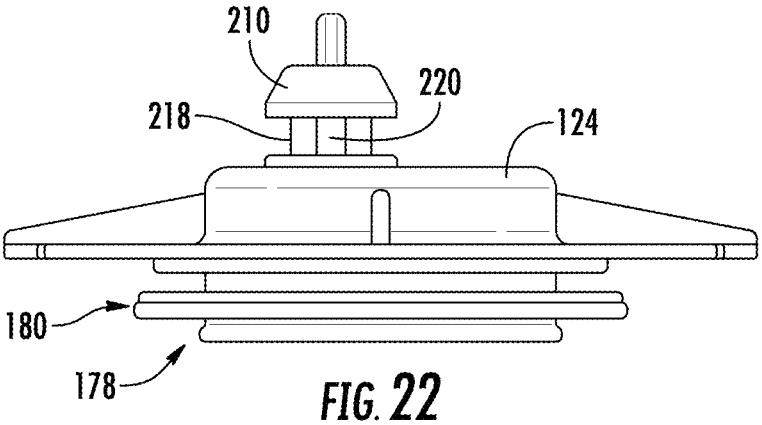
FIG. 22 is a side view illustration of the buoyancy assembly attachment of FIG. 21.

With reference to FIGS. 14, 16 and 22, the frame 110, and particularly the buoyancy assembly attachment 124 in this example, includes a seal mounting groove 240 that opens in a radially outward oriented direction. The first and second seal members 116, 118 attach to the frame 110 by way of the seal mounting groove 240.

The seal mounting groove 240 is an annular grove that has a bottom 242. The bottom 242 has a groove diameter.

The first and second seal members 116, 118 each having an inner diameter that is substantially equal to the groove diameter such that the first seal member 116 may be mounted to the frame 110 within the mounting groove 240 or the second seal member 118 may be mounted to the frame 110 within the mounting groove 240. However, other embodiments could have multiple grooves of different diameters if the seal members have different diameters.

With reference to FIGS. 14 and 16, the first seal member 116 has a first outer diameter sized to cooperate with valve seat 142 and the second seal member 118 has a second outer diameter sized to cooperate with valve seat 144. Notably, the second seal member outer diameter is bigger than the first outer diameter.

The outer diameter of the first seal member 116 is substantially the same as the outer diameter of the circular outer periphery of a flange portion 250 of the buoyancy assembly attachment 124 (see FIG. 14). A slight axial gap 252 is provided between the seal member 116 and the flange portion 250 to assist in sealing purposes. However, the flange portion 250 can provide axially support of the seal member 116 once the flush tank of the toilet is full.

With reference to FIG. 16, the second seal member 118 extends radially outward beyond the circular outer periphery of flange portion 250. To prevent undesirable dishing, which can make it difficult to pull up the flapper assembly and to open the flush valve, the seal member 118 has a ramped outer portion 254 that increases the stiffness of that portion of the seal member 118 that would not otherwise by supported by the flange portion 250.

To adjust the spacing S2 and S3, in some embodiments, the legs 122 themselves may have adjustable lengths. This could be useful in embodiments in which the main frame member 120 and the buoyancy assembly attachment 124 are formed from a single piece of material.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A toilet flapper assembly kit comprising:

a frame including a buoyancy assembly attachment having a buoyancy assembly attachment interface;

a first buoyancy assembly attachable to the buoyancy assembly attachment interface, the first buoyancy assembly providing a first amount of buoyancy when attached to the buoyancy assembly attachment; and a second buoyancy assembly attachable to the buoyancy assembly attachment interface, the second buoyancy assembly providing a second amount of buoyancy when attached to the buoyancy assembly attachment, the second amount being different than the first amount;

wherein:

the frame includes:

a) a main frame, the buoyancy assembly attachment is attachable to the main frame;

b) a pair of adjustable legs adjustably attachable to the main frame, the pair of legs being adjustable in at least one of a spacing between the legs or a length of the legs;

a first seal member having a first characteristic for sealing with a valve seat of a first size flapper valve assembly; and a second seal member having a second characteristic for sealing with a valve seat of a second size flapper valve assembly, the second size being different than the first size.

2. A toilet flapper assembly kit comprising:

a frame including a buoyancy assembly attachment having a buoyancy assembly attachment interface;

a first buoyancy assembly attachable to the buoyancy assembly attachment interface, the first buoyancy assembly providing a first amount of buoyancy when attached to the buoyancy assembly attachment; and a second buoyancy assembly attachable to the buoyancy assembly attachment interface, the second buoyancy assembly providing a second amount of buoyancy when attached to the buoyancy assembly attachment, the second amount being different than the first amount;

a first seal member having a first characteristic for sealing with a valve seat of a first size flapper valve assembly;

a second seal member having a second characteristic for sealing with a valve seat of a second size flapper valve assembly, the second size being different than the first size.

3. A toilet flapper assembly kit comprising:

a frame including a buoyancy assembly attachment having a buoyancy assembly attachment interface;

a first buoyancy assembly attachable to the buoyancy assembly attachment interface, the first buoyancy assembly providing a first amount of buoyancy when attached to the buoyancy assembly attachment; and a second buoyancy assembly attachable to the buoyancy assembly attachment interface, the second buoyancy assembly providing a second amount of buoyancy when attached to the buoyancy assembly attachment, the second amount being different than the first amount;

wherein:

the frame includes:

a) a main frame;

b) the buoyancy assembly attachment has a first buoyancy assembly attachment interface and a second buoyancy assembly attachment interface that is configured differently than the first buoyancy assembly attachment interface;

the first buoyancy assembly attachable to the first buoyancy assembly attachment interface;

the second buoyancy assembly attachable to the second buoyancy assembly attachment interface;

a first seal member attachable to the frame having a first characteristic for sealing with a valve seat of a first size flapper valve assembly;

a second seal member attachable to the frame having a second characteristic for sealing with a valve seat of a second size flapper valve assembly, the second size being different than the first size.

4. The toilet flapper assembly kit of claim 3, wherein:

the first buoyancy assembly attachment interface is a first annular undercut region and the first buoyancy assembly has a first radially extending annular project that snap engages with the first annular undercut region to secure the first buoyancy assembly to the buoyancy assembly attachment; and the second buoyancy assembly attachment interface is a second annular undercut region and the second buoyancy assembly has a second radially extending annular project that snap engages with the second annular undercut region to secure the second buoyancy assembly to the buoyancy assembly attachment.

5. The toilet flapper assembly kit of claim 3, wherein the first buoyancy assembly attachment interface has a first diameter and the second buoyancy assembly attachment interface has a second diameter that is different than the first diameter.

6. The toilet flapper assembly kit of claim 3, wherein:

the frame includes a pair of legs including a first leg and a second leg, the pair of legs being adjustably attachable to the main frame in at least one of a spacing between the legs or a length of the legs, each leg of the pair of legs has a first end attached to the main frame and a second end configured to mount the leg to a support in a pivotable manner about a flapper pivot axis;

the buoyancy assembly attachment is removably attachable to the main frame between first and second orientations, the first buoyancy assembly attachment interface and the second buoyancy assembly attachment interface being spaced farther from the flapper pivot axis in the first orientation than in the second orientation.

7. The toilet flapper assembly kit of claim 3, wherein the first and second buoyancy assembly attachment interfaces define a central axis and are axially offset from one another along the central axis.

8. The toilet flapper assembly kit of claim 3, wherein the main frame and buoyancy assembly attachment have a pin and receiver connection interface including an attachment pin extending from one of the main frame and the buoyancy assembly attachment and an attachment pin receiver provided by the other one of the main frame and the buoyancy assembly attachment, the attachment pin or attachment pin receiver provided by the buoyancy assembly attachment being positioned in a non-rotation symmetric manner about a central axis of the buoyancy assembly attachment such that insertion of the attachment pin into the attachment pin receiver along an insertion axis with a first relative angular orientation about the insertion axis positions the first and second buoyancy attachment interfaces in a first position relative to pair of legs and insertion of the attachment pin into the attachment pin receiver along the insertion axis with a second relative angular orientation about the insertion axis positions the first and second buoyancy attachment interfaces in a second position relative to the pair of legs.

9. The toilet flapper assembly kit of claim 8, wherein the attachment pin is insertable into the attachment pin receiver in a discrete number of relative angular orientations about the insertion axis with at least two of the discrete number of relative angular orientations being angularly spaced apart about the insertion axis 180 degrees.

10. The toilet flapper assembly kit of claim 8, wherein the attachment pin receiver has a non-circular inner periphery and the attachment pin has an alignment portion that has a non-circular outer periphery, the inner periphery of the attachment pin receiver and outer periphery of the alignment portion engaging to inhibit angular motion between the main frame and buoyancy assembly attachment when engaged.

11. The toilet flapper assembly kit of claim 3, wherein:

the buoyancy assembly attachment includes a first key and a second key;

the first buoyancy assembly has a third key that engages the first key when the first buoyancy assembly is attached to the buoyancy assembly attachment;

the second buoyancy assembly has a fourth key that engages the second key when the second buoyancy assembly is attached to the buoyancy assembly attachment; and the engagement of the first and third keys orienting the first buoyancy assembly at a different angular orientation about a central axis of the buoyancy assembly attachment than the angular orientation of the second buoyancy assembly about the central axis when the second and fourth keys engage.

12. The toilet flapper assembly kit of claim 11, wherein:

one of the first key and the third key is a first notch and the other one of the first key and the third key is a first projection; and one of the second key and the fourth key is a second notch and the other one of the second key and fourth key is a second projection.

13. The toilet flapper assembly kit of claim 3, wherein:

the first characteristic is an outer diameter of the first seal member; and the second characteristic is an outer diameter of the second seal member, the second diameter being different than the first diameter.

14. The toilet flapper assembly kit of claim 3, wherein the main frame and the buoyancy assembly attachment are formed as a one-piece, unitary body formed from a continuous piece of material.

15. The toilet flapper assembly kit of claim 3, wherein the first buoyancy assembly has a first volume and the second buoyancy assembly has a second volume that is less than the first volume.

16. The toilet flapper assembly kit of claim 3, wherein the frame includes a seal mounting groove that opens in a radially outward direction, the bottom of the mounting groove having a groove diameter, the first and second seal members each having an inner diameter that is substantially equal to the groove diameter such that the first seal member may be mounted to the frame within the mounting groove or the second seal member may be mounted to the frame within the mounting groove.

17. The toilet flapper assembly kit of claim 16, wherein the mounting groove is provided by the buoyancy assembly attachment.

18. The toilet flapper assembly kit of claim 3, wherein the frame includes a pair of legs including a first leg and a second leg, the pair of legs being adjustably attachable to the main frame in at least one of a spacing between the legs or a length of the legs, the frame includes at first pair of leg mounting features including a first inner leg mounting feature and a first outer leg mounting feature and a second pair of leg mounting features being laterally spaced apart from the first pair of leg mounting features including a second inner leg mounting feature and a second outer leg mounting feature, the first and second inner leg mounting features being positioned laterally between the first and second outer leg mounting features;

the first leg having a first cooperating feature configured to engage, selectively, the first inner and outer leg mounting features to vary a position of the first leg relative to the frame;

the second leg having a second cooperating feature configured to engage, selectively, the second inner and outer leg mounting features to vary a position of the second leg relative to the frame;

the first inner and outer leg mounting features are first male connectors and the first cooperating feature is a first female connector, each first male connector has an anti-rotation boss, an offset boss, and an oblong head portion, the offset boss being interposed between the anti-rotation boss and the oblong head portion, each first male connector defines a first leg mounting axis;

the first female connector includes an opening having an anti-rotation region having an inner periphery sized and shaped to engage the anti-rotation bosses to inhibit rotation of the first leg relative to the frame about the first leg mounting axis absent elastic deformation of one or both of the anti-rotation boss or the anti-rotation region, the first female connector includes a throat region offset from or provided by the anti-rotation region having an oblong cross-section sized to receive the oblong head therethrough when the first leg is in a first angular orientation about the first leg mounting axis relative to the frame and to prevent the oblong head from passing therethrough when the first leg is in a second angular orientation about the first leg mounting axis relative to the frame;

the second inner and outer leg mounting features are second male connectors and the second cooperating feature is a second female connector, each second male connector has an anti-rotation boss, an offset boss, and an oblong head portion, the offset boss being interposed between the anti-rotation boss and the oblong head portion, each second male connector defines a second leg mounting axis; and the second female connector includes an opening having an anti-rotation region having an inner periphery sized and shaped to engage the anti-rotation bosses to inhibit rotation of the second leg relative to the frame about the second leg mounting axis absent elastic deformation of one or both of the anti-rotation boss or the anti-rotation region, the second female connector including a throat region offset from or provided by the anti-rotation region having an oblong cross-section sized to receive the oblong head therethrough when the second leg is in a first angular orientation about the second leg mounting axis relative to the frame and to prevent the oblong head from passing therethrough when the second leg is in a second angular orientation about the second leg mounting axis relative to the frame.

19. A method of assembling a flapper assembly comprising:

providing a flapper assembly kit of claim 3;

attaching first and second legs to the frame at a selected spacing therebetween;

selecting one of the first or second buoyancy assemblies; and attaching the selected one of the first or second buoyancy assemblies to the frame.

20. The method of claim 19, further comprising:

selecting one of the first or second seal members;

attaching the selected one of the first or second seal members to the frame.

* * * * *